US011691770B2

(12) United States Patent
Spasov et al.

(10) Patent No.: US 11,691,770 B2
(45) Date of Patent: Jul. 4, 2023

(54) METHOD FOR POSITIONING AN EDGE-PROTECTOR AND APPARATUS FOR STRAPPING PACKAGES

(71) Applicant: Signode Industrial Group LLC, Glenview, IL (US)

(72) Inventors: Martin Spasov, Dusseldorf (DE); Friedhelm Schulz, Wipperfürth (DE)

(73) Assignee: Signode Industrial Group LLC, Tampa, FL (US)

( * ) Notice: Subject to any disclaimer, the term of this patent is extended or adjusted under 35 U.S.C. 154(b) by 108 days.

(21) Appl. No.: 17/441,427

(22) PCT Filed: Mar. 17, 2020

(86) PCT No.: PCT/US2020/023113
§ 371 (c)(1),
(2) Date: Sep. 21, 2021

(87) PCT Pub. No.: WO2020/197847
PCT Pub. Date: Oct. 1, 2020

(65) Prior Publication Data

US 2022/0177174 A1 Jun. 9, 2022

(30) Foreign Application Priority Data

Mar. 26, 2019 (DE) ..... 102019107702.8

(51) Int. Cl.
*B65B 13/18* (2006.01)
*B65B 57/12* (2006.01)
*B65B 11/58* (2006.01)

(52) U.S. Cl.
CPC ..... *B65B 13/181* (2013.01); *B65B 11/585* (2013.01); *B65B 57/12* (2013.01)

(58) Field of Classification Search
CPC ..... B65B 11/585; B65B 13/181; B65B 57/12
(Continued)

(56) References Cited

U.S. PATENT DOCUMENTS 1,770,099 A 7/1930 D'Humy et al.
3,241,287 A 3/1966 Chundelak
(Continued)

FOREIGN PATENT DOCUMENTS

CA 2050271 C 3/1992
CA 2639153 A1 3/2009
(Continued)

OTHER PUBLICATIONS

"Examination Report No. 1", from corresponding Australian patent application No. 2020245300, dated Sep. 19, 2022.
(Continued)

*Primary Examiner* — Stephen F. Gerrity
(74) *Attorney, Agent, or Firm* — Neal, Gerber & Eisenberg LLP

(57) ABSTRACT

Disclosed is a method for arranging an edge-protection device on a package. For this purpose, an arranging device is moved from a starting position in the direction of the package. The package edge is sensed by way of a first or a second sensor. Which sensor is to be used is determined by a controller. To this end, the latter checks whether one of the sensors is arranged above the package top side. Also disclosed is an arranging device, which is used in the above-mentioned method.

20 Claims, 6 Drawing Sheets

(58) Field of Classification Search
USPC ..... 53/139.6, 139.7
See application file for complete search history.

(56) References Cited

U.S. PATENT DOCUMENTS

| | | | | |
|---|---|---|---|---|
| 3,271,925 | A | 9/1966 | Aubery | |
| 3,378,987 | A | 4/1968 | Lems | |
| 3,381,443 | A | 5/1968 | Copping | |
| 3,585,780 | A | 6/1971 | Elmore | |
| 3,661,382 | A | 5/1972 | Spicer | |
| 3,735,555 | A | 5/1973 | Pasic | |
| 3,995,409 | A | 12/1976 | Discavage et al. | |
| 4,048,839 | A | 9/1977 | Peterpaul | |
| 4,238,663 | A | 12/1980 | Calhoun et al. | |
| 4,480,460 | A | 11/1984 | Bush et al. | |
| 4,535,224 | A | 8/1985 | Westerman | |
| 4,587,791 | A | 5/1986 | Brouse et al. | |
| 4,700,530 | A | 10/1987 | Norberg | |
| 4,878,334 | A | 11/1989 | Quinn | |
| 4,897,980 | A | 2/1990 | Geyser et al. | |
| 5,226,280 | A | 7/1993 | Scherer et al. | |
| 5,289,668 | A | 3/1994 | Meyer | |
| 5,307,664 | A | 5/1994 | Homm | |
| 5,311,996 | A | 5/1994 | Duffy et al. | |
| 5,394,505 | A | 2/1995 | Bidare | |
| 5,423,118 | A | 6/1995 | Lotti | |
| 5,535,572 | A | 7/1996 | Morantz et al. | |
| 5,546,730 | A | 8/1996 | Newell et al. | |
| 5,551,212 | A | 9/1996 | Odenthal | |
| 5,564,254 | A | 10/1996 | Thimon et al. | |
| 5,596,863 | A | 1/1997 | Kasel | |
| 5,619,838 | A | 4/1997 | Kasel | |
| 5,758,470 | A | 6/1998 | Lancaster | |
| 5,842,598 | A | 12/1998 | Tsuchida | |
| 5,878,548 | A | 3/1999 | Sauer et al. | |
| 5,899,046 | A | 5/1999 | Hughes | |
| 6,178,721 | B1 | 1/2001 | Turfan | |
| 6,540,080 | B2 | 4/2003 | Moreyra | |
| 6,775,956 | B1 | 8/2004 | Lacey | |
| 6,883,293 | B2 | 4/2005 | Lancaster et al. | |
| 7,213,381 | B2 | 5/2007 | Zitella et al. | |
| 7,237,478 | B1 | 7/2007 | Gosis et al. | |
| 7,383,952 | B2 | 6/2008 | Kruelle et al. | |
| 7,428,865 | B1 | 9/2008 | Kasel et al. | |
| 8,175,445 | B2 | 5/2012 | Morrison et al. | |
| 8,938,934 | B2 * | 1/2015 | Brunson et al. | B65B 13/181 53/139.7 |
| 9,932,134 | B2 | 4/2018 | Suolahti et al. | |
| 10,017,283 | B2 | 7/2018 | Kastner | |
| 10,099,808 | B2 | 10/2018 | Termanas et al. | |
| 10,926,902 | B2 | 2/2021 | Schulz et al. | |
| 2002/0014052 | A1 | 2/2002 | Suolahti | |
| 2003/0006012 | A1 | 1/2003 | Lai | |
| 2004/0216425 | A1 | 11/2004 | Morton et al. | |
| 2004/0237735 | A1 | 12/2004 | Diem | |
| 2004/0261360 | A1 | 12/2004 | Cere | |
| 2005/0108989 | A1 | 5/2005 | Dickner | |
| 2006/0266002 | A1 | 11/2006 | Zitella et al. | |
| 2010/0040353 | A1 | 2/2010 | Morrison et al. | |
| 2011/0219845 | A1 | 9/2011 | Schurder et al. | |
| 2012/0055123 | A1 | 3/2012 | Brunson et al. | |
| 2014/0311092 | A1 | 10/2014 | Flores et al. | |
| 2016/0114918 | A1 | 4/2016 | Kastner | |
| 2016/0152363 | A1 | 6/2016 | Termanas et al. | |
| 2018/0244413 | A1 | 8/2018 | Oehm et al. | |
| 2018/0319520 | A1 | 11/2018 | Termanas et al. | |
| 2021/0002009 | A1 | 1/2021 | Spasov | |

FOREIGN PATENT DOCUMENTS

| | | | | |
|---|---|---|---|---|
| CH | 406955 | A | 1/1966 | |
| DE | 610268 | C | 3/1935 | |
| DE | 1200212 | B | 9/1965 | |
| DE | 1225564 | B | 9/1966 | |
| DE | 1461764 | A1 | 2/1969 | |
| DE | 7149601 | U | 4/1972 | |
| DE | 2431153 | A1 | 1/1976 | |
| DE | 3025825 | A1 | 1/1982 | |
| DE | 3700146 | A1 | 7/1988 | |
| DE | 9311406 | U1 | 11/1993 | |
| DE | 19814941 | A1 | 10/1999 | |
| DE | 10012484 | A1 * | 9/2001 | B65B 13/181 |
| DE | 10223350 | A1 | 12/2003 | |
| DE | 202004015190 | U1 | 11/2004 | |
| DE | 202007018468 | U1 | 8/2008 | |
| DE | 202010006486 | U1 | 10/2011 | |
| DE | 102010030998 | A1 | 1/2012 | |
| DE | 102011012207 | A1 | 8/2012 | |
| DE | 202012004335 | U1 | 8/2013 | |
| DE | 202012008063 | U1 | 8/2013 | |
| DE | 202012008064 | U1 | 11/2013 | |
| DE | 102012016659 | A1 | 2/2014 | |
| DE | 102013004448 | B3 | 3/2014 | |
| DE | 202013002503 | U1 | 6/2014 | |
| DE | 102013004449 | A1 | 9/2014 | |
| DE | 202014008458 | U1 | 11/2014 | |
| DE | 202015104275 | U1 | 8/2015 | |
| EP | 1033305 | A1 | 9/2000 | |
| EP | 1491447 | A1 | 12/2004 | |
| EP | 1927545 | A1 | 6/2008 | |
| EP | 2202160 | A1 | 6/2010 | |
| EP | 2394916 | A1 | 12/2011 | |
| EP | 2778076 | A1 | 9/2014 | |
| EP | 2700577 | B1 | 10/2014 | |
| EP | 2660158 | B1 | 1/2015 | |
| EP | 2700578 | B1 | 1/2015 | |
| EP | 2700579 | B1 | 3/2015 | |
| EP | 2778075 | B1 | 6/2015 | |
| EP | 2778076 | B1 | 6/2015 | |
| EP | 2733077 | B1 | 9/2015 | |
| EP | 2878541 | B1 | 4/2016 | |
| EP | 3337726 | B1 | 7/2019 | |
| GB | 163422 | A | 5/1921 | |
| GB | 556374 | A | 10/1943 | |
| GB | 2213474 | A | 8/1989 | |
| JP | S5882814 | A | 5/1983 | |
| JP | S61145047 | A | 7/1986 | |
| JP | 2004331077 | A | 11/2004 | |
| WO | 9623610 | A1 | 8/1996 | |
| WO | 2009136188 | A1 | 11/2009 | |
| WO | 2009139686 | A1 | 11/2009 | |
| WO | 2010029451 | A1 | 3/2010 | |
| WO | 2010061312 | A2 | 6/2010 | |
| WO | 2020197847 | A1 | 10/2020 | |

OTHER PUBLICATIONS

"International Search Report and Written Opinion", from corresponding PCT/US2020/023113 (12 pages), dated Jun. 12, 2020.

* cited by examiner

METHOD FOR POSITIONING AN EDGE-PROTECTOR AND APPARATUS FOR STRAPPING PACKAGES

PRIORITY

This application is a national stage application of PCT/US2020/023113, filed on Mar. 17, 2020, which claims priority to and the benefit of German Patent Application No. 10 2019 107 702.8, filed Mar. 26, 2019, the entire contents of which are incorporated herein by reference.

FIELD

The present disclosure generally relates to methods for arranging an edge-protection device on a package in an apparatus for strapping packages, and apparatus for strapping packages.

BACKGROUND

Generic methods and apparatuses are well known from the prior art. For example, the applicant's EP2778076B1 discloses a strapping apparatus having a packaging table, which is provided with rollers in order to guide packages, in particular goods containers arranged on pallets, through the apparatus. A frame-like machine rack consists of two columns arranged to the right and left of the packaging table and of a press plate that is movable vertically up and down on the columns A strapping-device channel is formed along the columns and the press plate and along the packaging table. In said strapping-device channel, the strapping device is guided from the insertion location to the sealing head. In order to protect sensitive package edges from damage by the strapping device, edge-protection devices, usually paperboards or plastic angles, are arranged there prior to strapping. These reinforce the edges and prevent damage by the strapping device.

The abovementioned document shows how an edge-protection device, for example a paperboard, can be moved to a package by way of a carriage-like arranging device. The carriage is equipped, at a starting position close to the frame or column, with an edge-protection device and is then advanced as far as a package edge. The edge-protection device is set down there. The distance between the starting position and the package edge, i.e., the arranging position, is established by a detection device. This, according to the proposal by the abovementioned document, is a sensor integrated into a support. The sensor measures the distance from the side face of the package and extrapolates the position of the package edge therefrom.

The apparatus, known from the first prior art, together with the arranging method has proven to be extremely successful. However, in the case of packages having regions that protrude laterally beyond the upper package edge, erroneous detections can occur.

SUMMARY

Various embodiments of the present disclosure relate to a method for arranging an edge-protection device on a package in an apparatus for strapping packages, wherein the apparatus

- has a packaging table, on which the package is supported during the strapping operation,
- has a frame, which surrounds the package supported on the packaging table,

- has a track, which is located above the package and on which an arranging device for edge-protection device is arranged so as to be movable between a starting position and a placement position,
- wherein the arranging device has at its front a first detection device, with which the position of the arranging device relative to the package is able to be determined, wherein the arranging device has at its rear a second detection device, with which the position of the arranging device relative to the package is able to be determined.

Various embodiments of the present disclosure also relate to an apparatus for strapping packages

- having a packaging table, on which the package is arranged during strapping,
- having a frame, which surrounds the package arranged on the packaging table,
- having a track, which is arranged above the package,
- having an arranging device for an edge-protection device, said arranging device being arranged on the track and being movable thereon in the direction of the package and back again,
- having a first detection device on the arranging device for sensing the package edge and a second detection device on the arranging device for sensing the package edge.

Various advantages of the present disclosure are achieved firstly by a method having the features described above, in particular having the following method steps:

1) checking whether the first detection device is arranged above the package, if the first detection device is not arranged above the package:
   - 1a) moving the arranging device forward (X) in the direction of travel from the starting position,
   - 1b) sensing the package edge with the first detection device,
   - 1c) moving the arranging device to the position, close to the package edge, necessary for the arrangement of the edge-protection device,
   - 1d) arranging the edge-protection device on the package,
   - 1e) moving the arranging device backwards in the direction of travel into its starting position, if the first detection device is arranged above the package:
2) checking whether the second detection device is arranged above the package, if the second detection device is not arranged above the package:
   - 2a) moving the arranging device forward (X) in the direction of travel from the starting position,
   - 2b) sensing the package edge with the second detection device,
   - 2c) moving the arranging device to the position, close to the package edge, necessary for the arrangement of the edge-protection device,
   - 2d) arranging the edge-protection device on the package,
   - 2e) moving the arranging device backwards in the direction of travel into its starting position.

In this novel method, the first detection device is first of all interrogated to check whether the package edge is essentially able to be detected. This is essentially the case when the first detection device is located vertically next to the package, i.e., the top side is not able to be sensed by the detection device.

The arrangement of the detection device on the carriage for arranging the edge protector itself ensures that the package edge itself is detected and it is not necessary to extrapolate the position of the package edge from the detections of a package side face. The detection of the package edge itself takes place in that the carriage is moved in the direction of the package until the detection device detects the position of the package edge. Then, the carriage is moved into its arranging position, which results from the position of the first detection device relative to the gripping tool for the edge-protection device.

Since, in the case of very wide packages, it is possible however for the package top side to be arranged beneath the first detection device, a second detection device is provided at the rear of the carriage. If the first detection device is occupied by a package top side located therebeneath, it is not possible for the package edge to be sensed by the first detection device. In this case, the carriage is moved forward until the second detection device, arranged at the rear of the carriage, senses a package edge. As soon as this is the case, the carriage is moved into the arranging position for setting down the edge-protection device on the package edge. In this case, the arranging position is determined from the relative position of the second detection device with respect to the holding tool of the edge-protection device.

In this case, it is preferred for a check also to be carried out as to whether the second detection device is arranged above the package top side.

If the first and second detection devices are arranged above the package top side, an error message is output and the carriage remains in its starting position.

It is envisaged that when the package edge is detected by the first detection device, the carriage is moved further forwards in the direction of travel into its arranging position.

Furthermore, a method step is preferred in which, after the package edge is detected by the second detection device, the carriage is moved backwards into its arranging position.

Various advantages provided by the present disclosure are also achieved by an apparatus having a control device suitable for moving the arranging device forward (X) in the direction of travel to the package, moving the arranging device forward (X) in the direction of travel if the first detection device senses a package edge and then positioning the edge-protection device carried by the arranging device on the package edge, and moving the arranging device forward (X) in the direction opposite to the direction of travel if the second detection device senses a package edge and then positioning the edge-protection device carried by the arranging device on the package edge.

One advantage of the apparatus is primarily that the first and the second detection device are arranged on the carriage itself and thus, by moving the carriage in the direction of the package, the package edge can be detected when the package is passed over. It is no longer necessary to identify the position of the package edge by measuring the distance between the frame and package side face, which can result in erroneous detections in particular in the case of irregular package side faces.

Using a first detection device at the carriage front and a second detection device at the carriage rear, it is possible to reliably provide an edge-protection device even on those packages that, on account of their width, pass through the apparatus beneath the first detection device, or to reliably provide edge-protection device on packages that do not pass in centrally, but rather erroneously in a laterally offset manner.

Reliable detection of the package edge is ensured when the detection devices detect substantially in the direction of the packaging table.

A particular advantage is furthermore afforded when the detection devices are photocells.

The control device advantageously makes it possible to provide edge-protection device even on packages that, on account of their size or defective entry into the strapping apparatus, impede the measurement by the first detection device with their package top side.

BRIEF DESCRIPTION OF THE FIGURES

Further advantages and a better understanding of the present disclosure will become apparent from the following description of an exemplary embodiment. In the figures.

DETAILED DESCRIPTION

Figure 1:
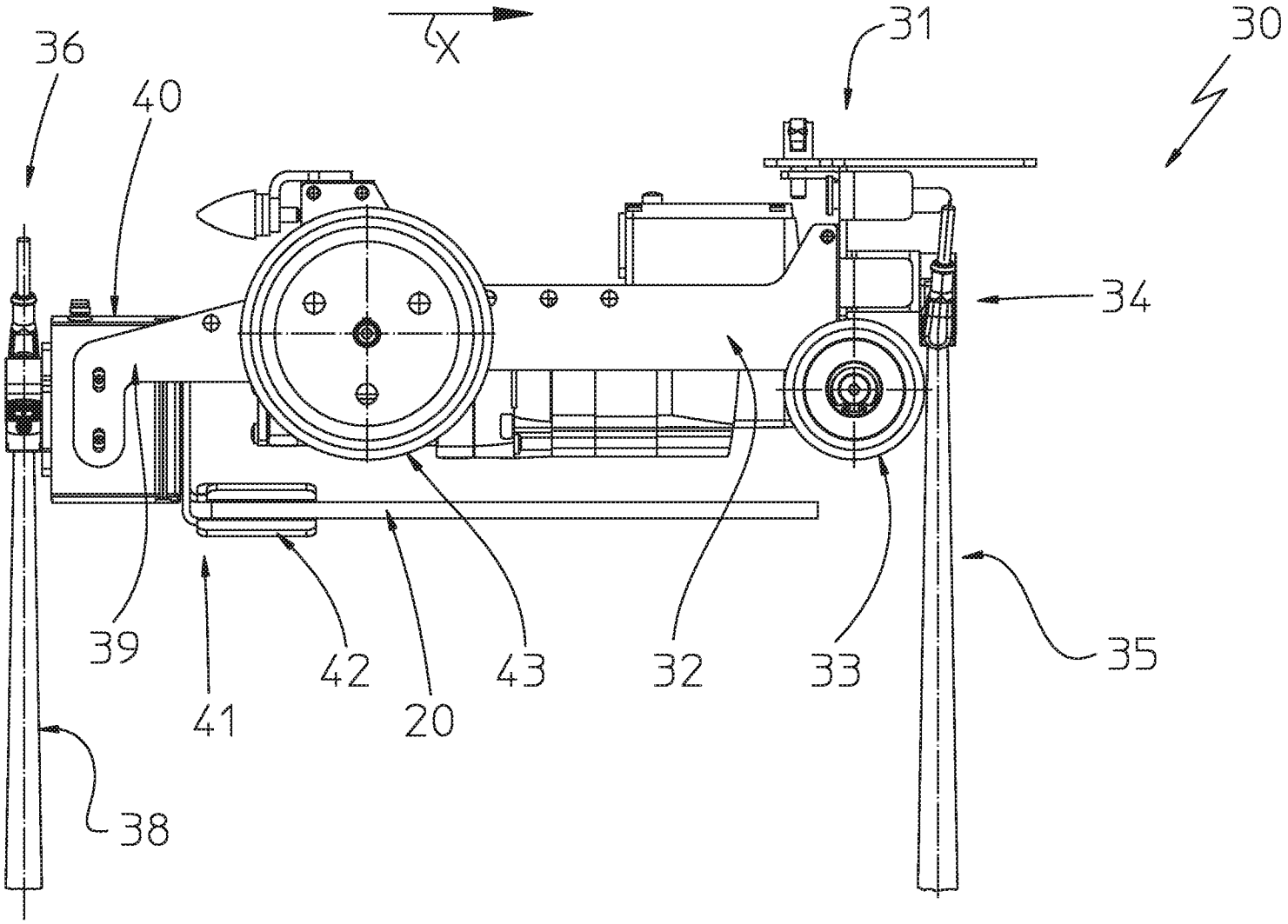
FIG. 1 shows a side view of the carriage for edge-protector arrangement of an apparatus according to one embodiment of the present disclosure.

While the systems, devices, and processes described herein may be embodied in various forms, the drawings show and the specification describes certain exemplary and non-limiting embodiments. Not all of the components shown in the drawings and described in the specification may be required, and certain implementations may include additional, different, or fewer components. Variations in the arrangement and type of the components; the shapes, sizes, and materials of the components; and the manners of connections of the components may be made without departing from the spirit or scope of the claims. Unless otherwise indicated, any directions referred to in the specification reflect the orientations of the components shown in the corresponding drawings and do not limit the scope of the present disclosure. Further, terms that refer to mounting processes, such as mounted, connected, etc., are not intended to be limited to direct mounting processes but should be interpreted broadly to include indirect and operably mounted, connected, and like mounting processes. This specification is intended to be taken as a whole and interpreted in accordance with the principles of the present disclosure and as understood by one of ordinary skill in the art.

Figure 3:
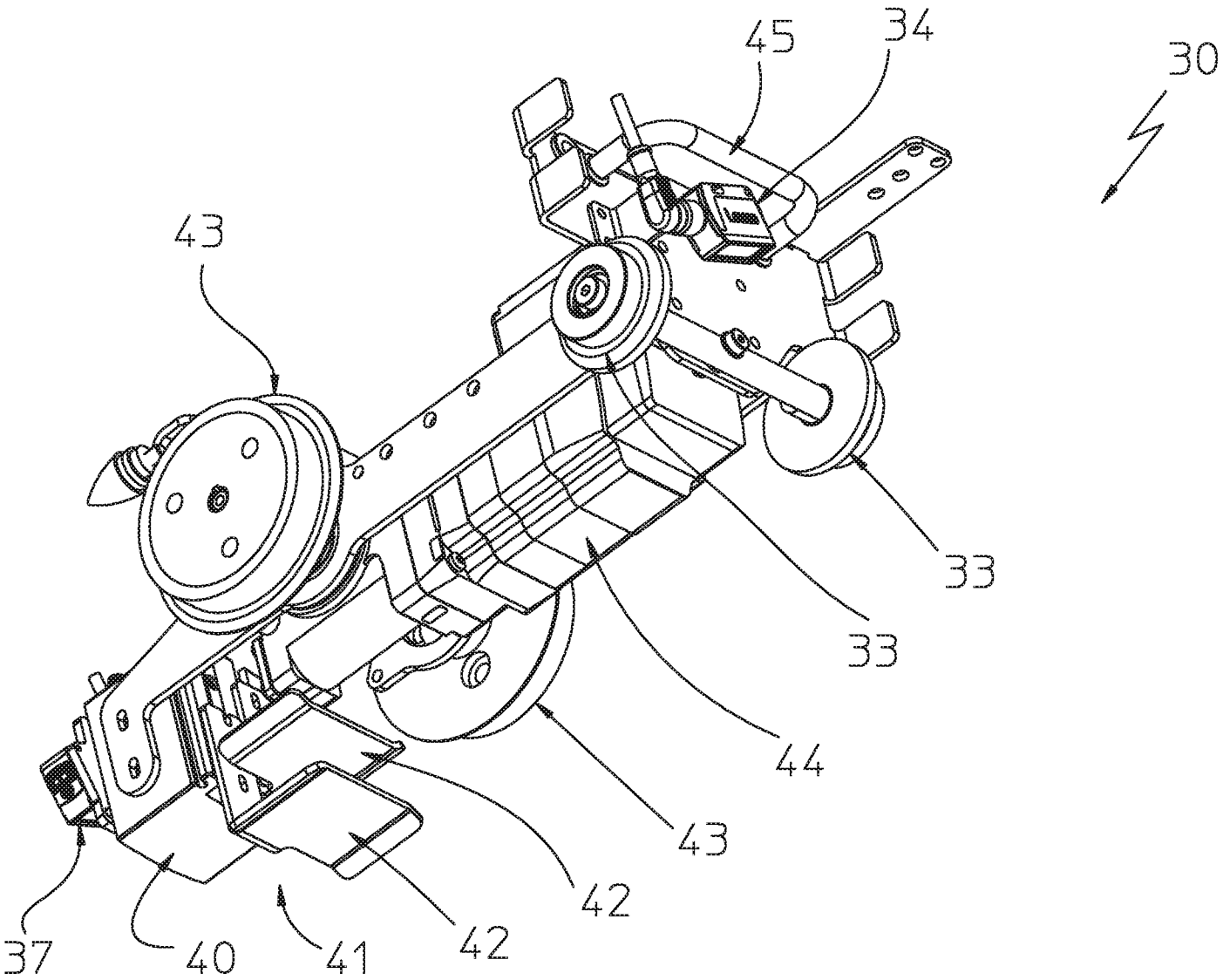
FIG. 3 shows a perspective bottom view of the carriage according to FIG. 1.
Figure 4:
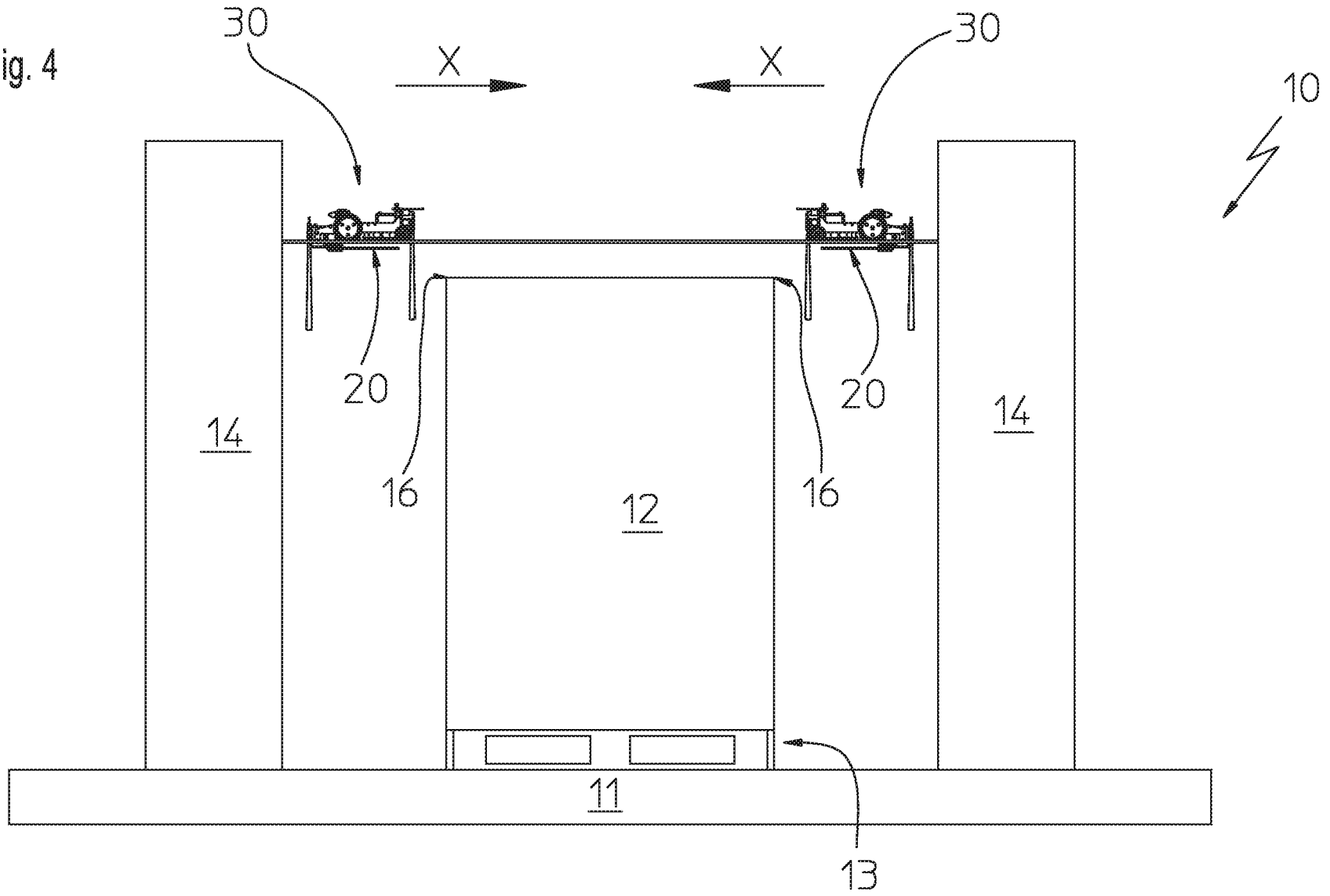
FIG. 4 shows a schematic illustration of a strapping apparatus according to one embodiment of the present disclosure with the carriage in a starting position.
Figure 5:
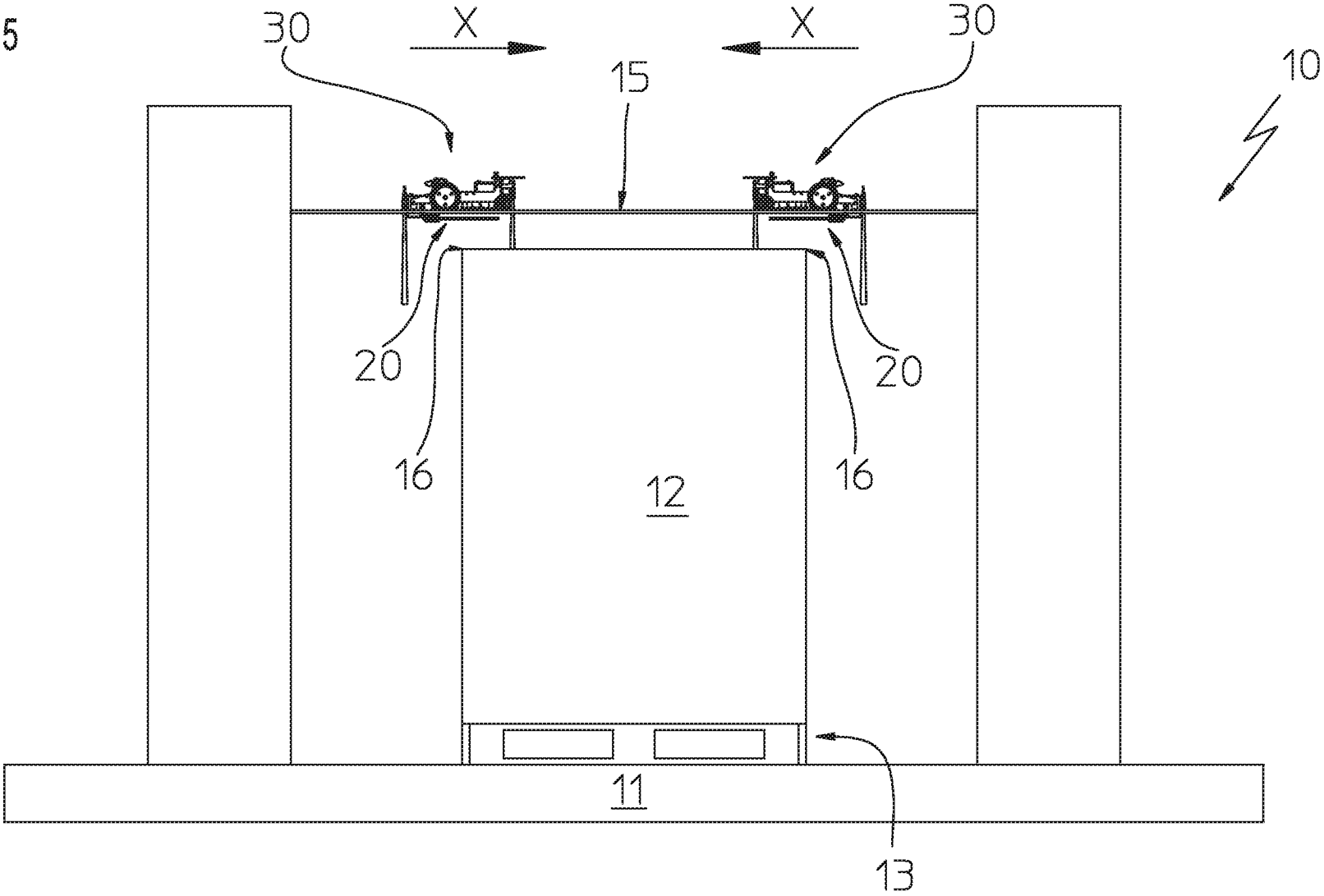
FIG. 5 shows an illustration as per FIG. 4 with the carriage in an arranging position.
Figure 6:
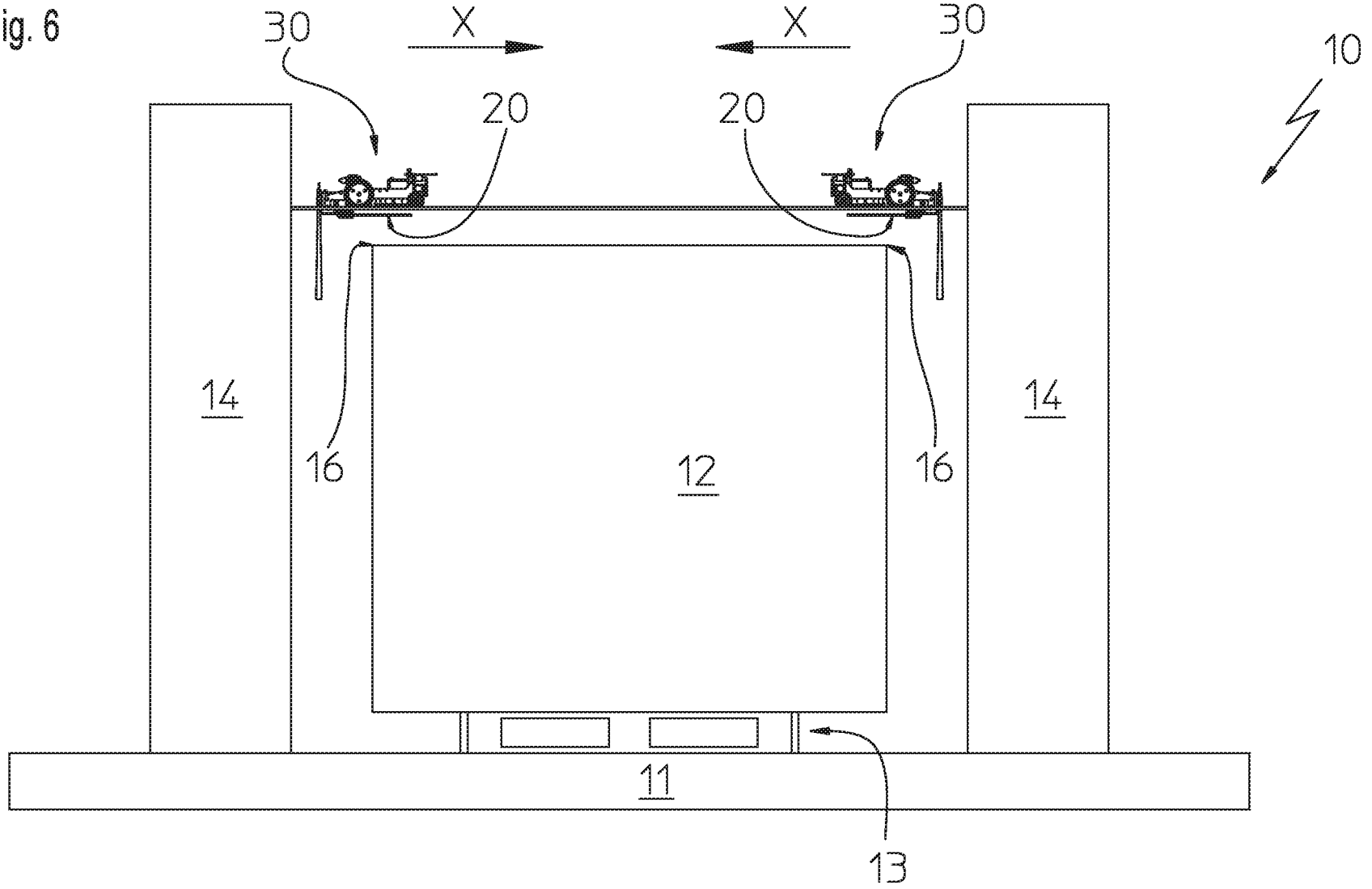
FIG. 6 shows an illustration as per FIG. 4 with an excessively wide package.

FIGS. 4 to 6 schematically illustrate a package strapping apparatus according to one embodiment of the present disclosure, which is provided overall with the reference numeral 10. An arranging device for edge-protection device in the form of a carriage is illustrated in various views in FIGS. 1 to 3 and provided overall with the reference numeral 30.

The strapping apparatus 10 illustrated in FIGS. 4 to 6 comprises a packaging table 11, on which packages 12 are arranged in order to be strapped in a strapping device. In the exemplary embodiment, the package 12 is moved through the apparatus on a pallet 13.

A press plate is arranged in a vertically movable manner on two columns 14 located to the right and left of the packaging table 11. The press plate not illustrated here for reasons of simplification. The press plate provides a track 15 for two carriages 30. The carriages 30 serve to arrange edge-protection device 20 on the upper package edges 16 exposed to the strapping device.

Figure 2:
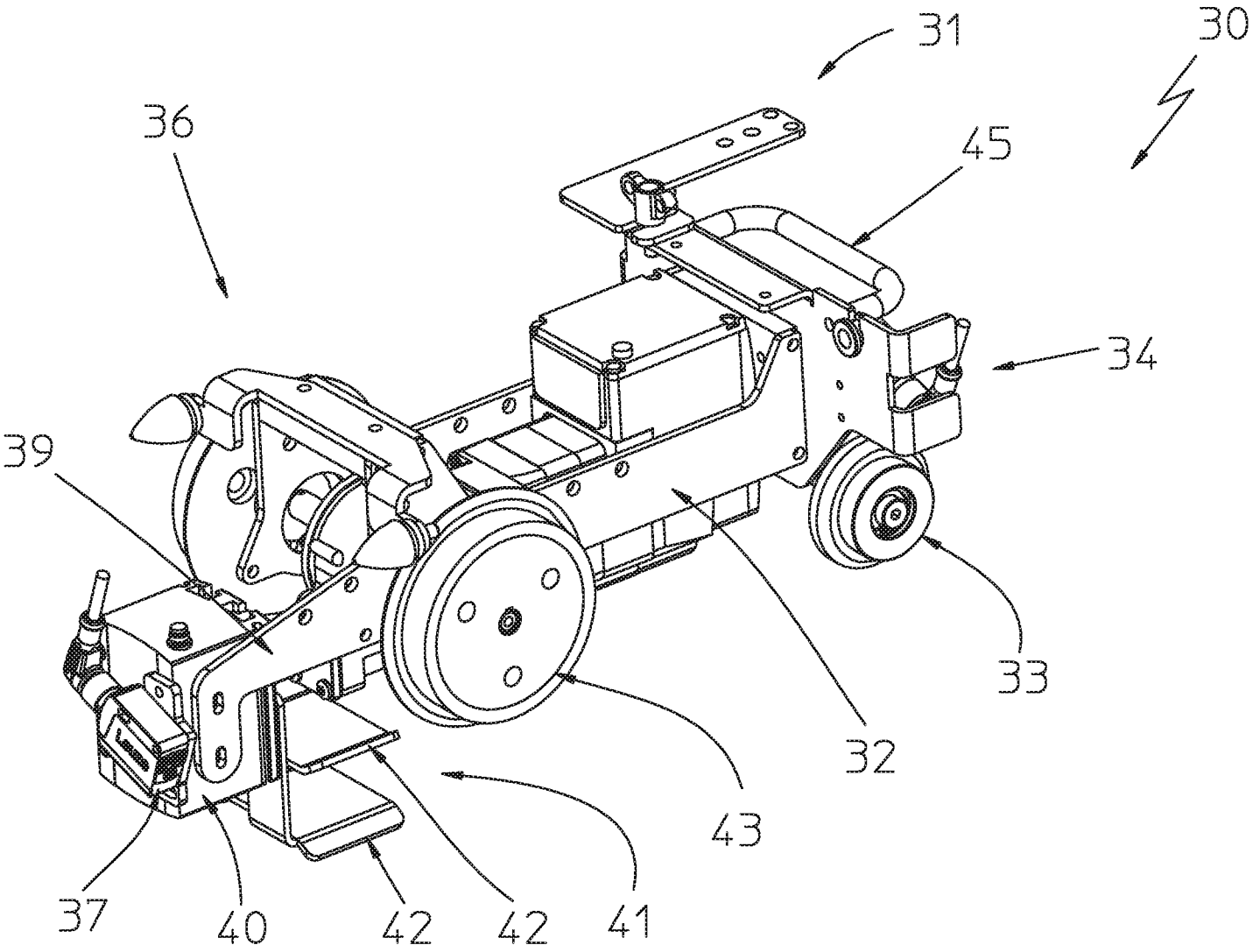
FIG. 2 shows a perspective view of the rear of the carriage according to FIG. 1.

The carriage 30 illustrated in FIGS. 1 to 3 has a carriage front 21, which is arranged at the front with regard to the forward direction of travel in the direction X and has two front wheels 33 that accommodate the carriage chassis 32 between one another. Arranged at the carriage front 31 is a first detection device 34, wherein this is a sensor in the form of a photocell in this example embodiment. The first detection device 34 is directed substantially vertically downwards and is illustrated symbolically by way of a first detection beam 35.

With regard to the forward direction of travel X, the carriage 30 has a carriage rear 36, which is provided with a second detection device 37, which is fastened at the rear of the carriage 30 in the forward direction of travel X. The detection direction of the second detection device 37 is likewise directed substantially vertically downwards and is illustrated symbolically by a second detection beam 38.

At the vehicle rear 36, the carriage chassis 32 forms a retaining arm 39, which carries an actuator 40 for a gripping tool 41 arranged on the actuator 40. The gripping tool 41 has two clamping jaws 42 that are movable relative to one another and are movable into an open position and a closed position by the actuator 40. In the open position illustrated in FIGS. 2 and 3, an edge-protection device 20, illustrated only in FIG. 1, can be introduced between the clamping jaws 42 and is held by the clamping jaws 42 in the closed position (see FIG. 1). Rear wheels 43, which have a larger diameter than the front wheels 33, accommodate the chassis 32 between one another in the rear region 36.

FIGS. 2 and 3 show that, between the front wheels 33 and the rear wheels 43, the carriage chassis 32 carries a drive 44, which acts on the rear wheels 43 and by way of which the carriage can be set in motion.

A handle 45 located at the front 31 of the carriage 30 makes it easier to handle the carriage 30 when it is being mounted on and removed from the apparatus 10 and during maintenance or otherwise.

FIGS. 4 to 6 explain in more detail how the carriages 30 place edge-protection device 20 on the upper package edges 16 of the package 12.

In FIG. 4, the carriages 30 are in their starting position. Edge-protection device 20 have been introduced into the gripping tool 41, in order to be arranged on the package edges 16. The first and the second detection device 34 and 37 are interrogated about the existence of a plausibility value. The plausibility value exists when the detection device is free, i.e., no package is arranged beneath the detection devices 34 and 37. The system controller assumes that the two detection devices 34 and 37 are functioning correctly. The existence of the plausibility value of the first detection device 34, i.e., the front detection device 34 in the direction of travel at the carriage front 31, also means that this first detection device 34 can be used to detect the package edge 16. Values from the second detection device 37 are ignored.

The carriages 30 now both travel forwards in the direction of travel. The first detection device 34 detects the position of the package edge 16 on passing over the latter. The system controller calculates from the position of the package edge 16 the movement in the forward direction X that is still required until the arranging position, illustrated in FIG. 5, for placing the edge protector 20 on the package edge 16 is reached. This value can be determined from the position of the gripping tool 41 with respect to the front, first detection device 34 and the width, measured in the direction of travel X, of the edge-protection device 20. These values are transmitted to the system controller as actual values before the apparatus is put into operation.

FIG. 6 now shows an illustration as per FIG. 4. The carriages 30 are in a starting position, provided with an edge-protection device 20 in the gripping tool 41. A much wider package, compared with FIG. 4, stands with its top side beneath the first, front detection devices 34 of the carriages 30. If the plausibility value is now requested, this is absent for the front detection devices 34, but the rear, second detection devices 37 do return the plausibility value.

Therefore, to control the carriages, the signal from the first detection devices 34 is ignored, and instead the second detection devices 37 are used for detecting the package edges 16. The controller causes the carriages 30 to move forwards in the direction of travel X until the second detection devices 37 pass over the package edges 16. In the process, the position of the package edges 16 is detected. The controller will now calculate the travel that the carriages 30 have to cover until an arranging position for the edge-protection device 20 is reached. To this end, the carriages 30 are moved counter to the forward direction X back in the direction of the starting position. In this case, the arranging position is calculated from the relative position of the second detection device 37 with respect to the gripping tool 41, taking the edge-protection-device width measured in the direction of travel X into consideration.

In an example that is not illustrated here, it is conceivable for a package not to enter centrally between the supports 14 but in a laterally offset manner. In this case, it is possible for the plausibility value of the first detection device 34 of one of the carriages to be absent, but to exist at the second carriage 30. In this case, the carriages 30 are controlled differently from one another. The carriage 30 for which the plausibility value exists for both detection devices 34 and 37 uses only the first detection device 34 to identify the arranging positions. The carriage 30 for which only the plausibility value for the rear, second detection device 37 exists uses this very rear detection device 37 to identify the arranging position of the edge-protection device 20.

The invention claimed is:

1. An apparatus for strapping a package, the apparatus comprising:

a packaging table for supporting the package during strapping;

a track above the packaging table;

a carriage movable along the track in a forward direction from a starting position toward the package and in a backward direction opposite the forward direction, the carriage having:

a carriage front;

a carriage back;

a first detection device closer to the carriage front than the carriage back;

a second detection device closer to the carriage back than the carriage front; and a gripper configured to receive, hold, and release an edge protector; and a controller configured to, after the package has been introduced onto the packaging table and the gripper has received and held the edge protector:

determine whether the first detection device detects the package while the carriage is in the starting position; and responsive to the first detection device detecting the package while the carriage is in the starting position:

move the carriage in the forward direction until the second detection device detects the package; and responsive to the second detection device detecting the package, move the carriage in the backward direction until the carriage reaches an arrangement position at which the edge protector is to be released.

2. The apparatus of claim 1, wherein the controller is further configured to determine the arrangement position based at least in part on a distance between the second detection device and the gripper.

3. The apparatus of claim 1, wherein at least one of the first and second detection devices comprises a photocell.

4. The apparatus of claim 1, wherein the arrangement position comprises a first arrangement position, wherein the controller is further configured to, responsive to the first detection device not detecting the package while the carriage is in the starting position:

move the carriage in the forward direction until the first detection device detects the package; and responsive to the first detection device detecting the package, continue moving the carriage in the forward direction until the carriage reaches a second arrangement position at which the edge protector is to be released, the second arrangement position different than the first arrangement position.

5. The apparatus of claim 4, wherein the controller is further configured to determine the second arrangement position based at least in part on a distance between the first detection device and the gripper.

6. The apparatus of claim 5, wherein the controller is further configured to determine whether the second detection device detects the package while the carriage is in the starting position and, responsive to determining that the second detection device detects the package while the carriage is in the starting position, output an error message.

7. The apparatus of claim 1, wherein the controller is further configured to determine whether the second detection device detects the package while the carriage is in the starting position and, responsive to determining that the second detection device detects the package while the carriage is in the starting position, output an error message.

8. The apparatus of claim 1, wherein the carriage comprises a first carriage, the forward direction comprises a first-carriage forward direction, the backward direction comprises a first-carriage backward direction, the carriage front comprises a first-carriage front, the carriage back comprises a first-carriage back, the gripper comprises a first gripper, the arrangement position comprises a first-carriage arrangement position, the starting position comprises a first-carriage starting position, and the edge protector comprises a first edge protector, wherein the apparatus further comprises:

a second carriage movable along the track in a second-carriage forward direction from a second-carriage starting position toward the package and in a second-carriage backward direction opposite the second-carriage forward direction, the second carriage having:

a second-carriage front;

a second-carriage back;

a third detection device closer to the second-carriage front than the second-carriage back;

a fourth detection device closer to the second-carriage back than the second-carriage front; and a second gripper configured to receive, hold, and release a second edge protector; and wherein the controller is further configured to, after the package has been introduced onto the packaging table and first and second grippers have received and held the first and second edge protectors:

determine whether the third detection device detects the package while the second carriage is in the second-carriage starting position; and responsive to the third detection device detecting the package while the second carriage is in the second-carriage starting position:

move the second carriage in the second-carriage forward direction until the fourth detection device detects the package; and responsive to the fourth detection device detecting the package, move the second carriage in the second-carriage backward direction until the second carriage reaches a second-carriage arrangement position at which the second edge protector is to be released.

9. The apparatus of claim 8, wherein the controller is further configured to, responsive to the first detection device not detecting the package while the first carriage is in the first-carriage starting position:

move the first carriage in the first-carriage forward direction until the first detection device detects the package; and responsive to the first detection device detecting the package, continue moving the first carriage in the first-carriage forward direction until the first carriage reaches another arrangement position different from the first- and second-carriage arrangement positions at which the first edge protector is to be released.

10. The apparatus of claim 8, wherein the controller is further configured to determine whether the second and fourth detection devices detect the package while the first and second carriages are in the first- and second-carriage starting positions and, responsive to determining that at least one of the second and fourth detection devices detects the package, output an error message.

11. An edge-protector positioning method comprising:

introducing a package on a packaging table;

while a carriage positioned above the packaging table is holding an edge protector and in a starting position, determining whether a first detection device of the carriage detects the package; and responsive to the first detection device detecting the package while the carriage is in the starting position:

moving the carriage in a forward direction from the starting position toward the package until a second detection device of the carriage detects the package; and responsive to the second detection device detecting the package, moving the carriage in a backward direction opposite the forward direction until the carriage reaches an arrangement position at which the edge protector is to be released.

12. The method of claim 11, further comprising determining the arrangement position based at least in part on a distance between the second detection device and a gripper.

13. The method of claim 11, wherein moving the carriage comprises moving the carriage along a track positioned above the packaging table.

14. The method of claim 11, wherein the arrangement position comprises a first arrangement position, the method further comprising, responsive to the first detection device not detecting the package while the carriage is in the starting position:

moving the carriage in the forward direction until the first detection device detects the package; and responsive to the first detection device detecting the package, continuing to move the carriage in the forward direction until the carriage reaches a second arrangement position at which the edge protector is to be released, the second arrangement position different than the first arrangement position.

15. The method of claim 14, further comprising determining the second arrangement position based at least in part on a distance between the first detection device and a gripper.

16. The method of claim 15, further comprising determining whether the second detection device detects the package while the carriage is in the starting position and, responsive to determining that the second detection device detects the package while the carriage is in the starting position, outputting an error message.

17. The method of claim 11, further comprising determining whether the second detection device detects the package while the carriage is in the starting position and, responsive to determining that the second detection device detects the package while the carriage is in the starting position, outputting an error message.

18. The method of claim 11, wherein the carriage comprises a first carriage, the forward direction comprises a first-carriage forward direction, the backward direction comprises a first-carriage backward direction, the arrangement position comprises a first-carriage arrangement position, the starting position comprises a first-carriage starting position, and the edge protector comprises a first edge protector, the method further comprising:

while a second carriage is positioned above the packaging table, is holding a second edge protector, and is in a second-carriage starting position, determining whether a third detection device of the second carriage detects the package; and responsive to the third detection device detecting the package while the second carriage is in the second-carriage starting position:

moving the second carriage in a second-carriage forward direction from the second-carriage starting position toward the package until a fourth detection device of the second carriage detects the package; and responsive to the fourth detection device detecting the package, moving the second carriage in a second-carriage backward direction opposite the second-carriage forward direction until the second carriage reaches a second-carriage arrangement position at which the second edge protector is to be released.

19. The method of claim 18, further comprising, responsive to the first detection device not detecting the package while the first carriage is in the first-carriage starting position:

moving the first carriage in the first-carriage forward direction until the first detection device detects the package; and responsive to the first detection device detecting the package, continuing to move the first carriage in the first-carriage forward direction until the first carriage reaches another arrangement position different from the first- and second-carriage arrangement positions at which the first edge protector is to be released.

20. The method of claim 18, further comprising determining whether the second and fourth detection devices detect the package while the first and second carriages are in the first- and second-carriage starting positions and, responsive to determining that at least one of the second and fourth detection devices detects the package, outputting an error message.

* * * * *